US010175623B2

(12) United States Patent
Suzue

(10) Patent No.: US 10,175,623 B2
(45) Date of Patent: Jan. 8, 2019

(54) IMAGE FORMING SYSTEM, IMAGE READING APPARATUS, IMAGE FORMING METHOD, AND CONTROL PROGRAM

(71) Applicant: Konica Minolta, Inc., Chiyoda-ku, Tokyo (JP)

(72) Inventor: Tadashi Suzue, Hachioji (JP)

(73) Assignee: Konica Minolta, Inc., Chiyoda-ku, Tokyo (JP)

( * ) Notice: Subject to any disclaimer, the term of this patent is extended or adjusted under 35 U.S.C. 154(b) by 0 days.

(21) Appl. No.: 15/806,770

(22) Filed: Nov. 8, 2017

(65) Prior Publication Data

US 2018/0150008 A1 May 31, 2018

(30) Foreign Application Priority Data

Nov. 25, 2016 (JP) ..... 2016-228762

(51) Int. Cl.
*G03G 15/00* (2006.01)
*G03G 15/23* (2006.01)

(52) U.S. Cl.
CPC ..... *G03G 15/231* (2013.01); *G03G 15/5029* (2013.01); *G03G 15/6594* (2013.01); *G03G 15/238* (2013.01)

(58) Field of Classification Search
CPC ..... G03G 15/231; G03G 15/238; G03G 15/5029; G03G 15/6579; G03G 2215/00021; G03G 2215/00586; G03G 15/6594; B41J 3/60
USPC ..... 399/45, 394, 401
See application file for complete search history.

(56) References Cited

U.S. PATENT DOCUMENTS 5,708,935 A * 1/1998 Rabjohns ..... G03G 15/231 399/193
2007/0133069 A1* 6/2007 Sunada ..... G03G 15/234 358/498
2011/0097125 A1* 4/2011 deJong ..... G03G 15/6564 399/394
2012/0019847 A1 1/2012 Yamauchi
2014/0029961 A1* 1/2014 Ueda ..... G03G 15/0131 399/394 X
2016/0124363 A1* 5/2016 Takahashi ..... G03G 15/5029 399/45

FOREIGN PATENT DOCUMENTS

JP 2012-027099 A 2/2012

* cited by examiner

*Primary Examiner* — Sophia S Chen
(74) *Attorney, Agent, or Firm* — Buchanan Ingersoll & Rooney PC

(57) ABSTRACT

An image forming system, includes: an image former that performs image formation on a transfer medium; and a controller that acquires a detection result of detecting the transfer medium by a detector with respect to a length of the transfer medium, wherein the controller sets an image forming condition for the transfer medium on the basis of the length of the transfer medium obtained from the detection result.

27 Claims, 12 Drawing Sheets

FIG. 3

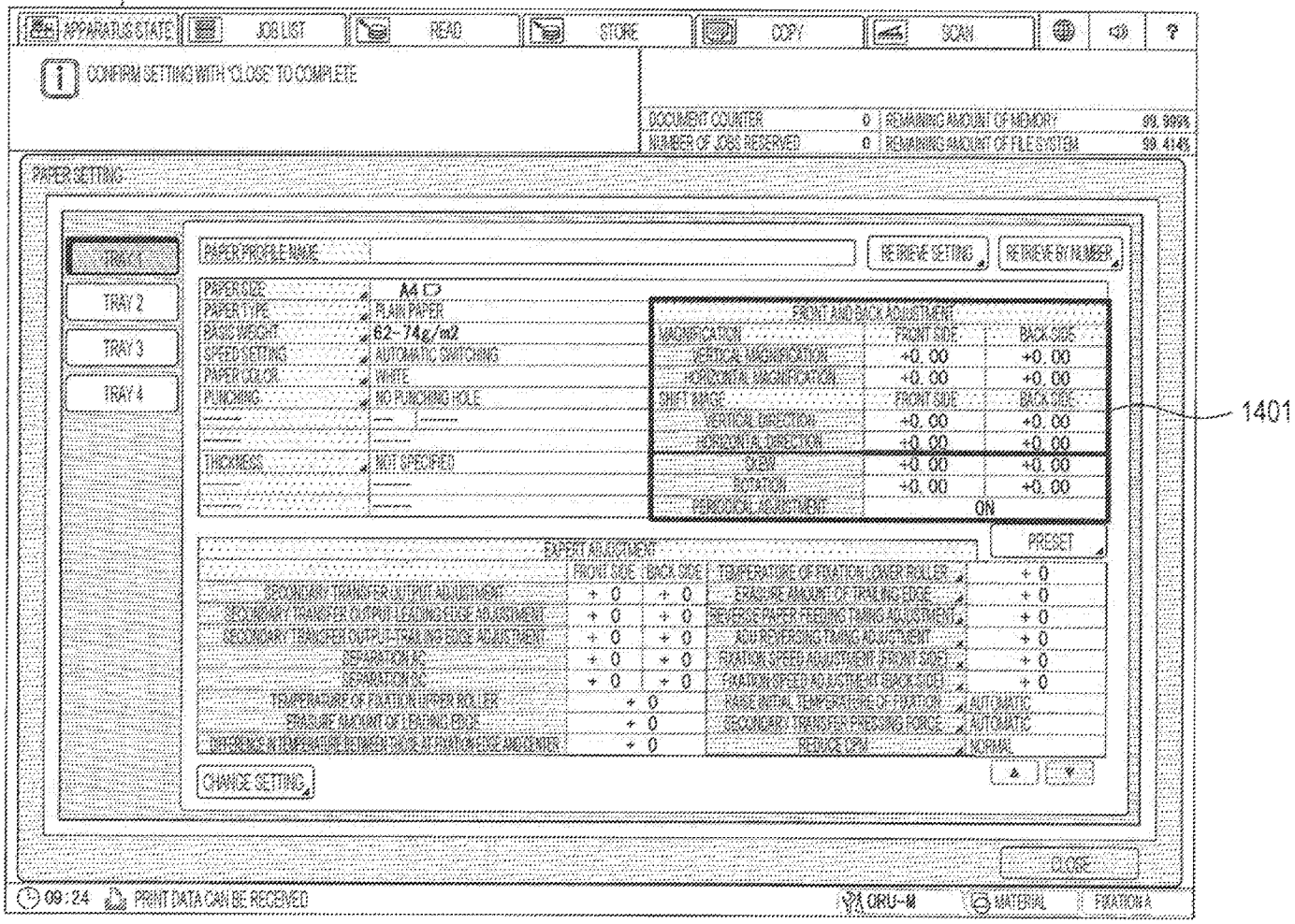
1400
1401
APPARATUS STATE
JOB LIST
READ
STORE
COPY
SCAN
CONFIRM SETTING WITH 'CLOSE' TO COMPLETE
DOCUMENT COUNTER
NUMBER OF JOBS RECEIVED
REMAINING AMOUNT OF MEMORY
REMAINING AMOUNT OF FILE SYSTEM
PAPER SETTING
TRAY 1
TRAY 2
TRAY 3
TRAY 4
PAPER SIZE
PAPER TYPE
PAPER WEIGHT
SPEED SETTING
PAPER COLOR
PUNCHING
A4 ▢
PLAIN PAPER
62-74g/m2
AUTOMATIC SWITCHING
WHITE
NO PUNCHING HOLE
THICKNESS
NOT SPECIFIED
PAPER SIZE NAME
REFERENCE SETTING
REFERENCE BY NUMBER
PRINT AND BACK ADJUSTMENT
FRONT SIDE
BACK SIDE
MODIFICATION
VERTICAL MAGNIFICATION
HORIZONTAL MAGNIFICATION
SHIFT IMAGE
VERTICAL DIRECTION
HORIZONTAL DIRECTION
SKEW
ROTATION
REDUCE ADJUSTMENT
ON
PRESET
PAPER ADJUSTMENT
FRONT SIDE
BACK SIDE
SECONDARY TRANSFER OUTPUT ADJUSTMENT
SECONDARY TRANSFER COPY LEADING EDGE ADJUSTMENT
SECONDARY TRANSFER COPY TRAILING EDGE ADJUSTMENT
DEVELOPING
DEVELOPING
TEMPERATURE OF FIXING ROLLER
IMAGE MAGNIFICATION CHANGE

IMAGE FORMING SYSTEM, IMAGE READING APPARATUS, IMAGE FORMING METHOD, AND CONTROL PROGRAM

Japanese Patent Application No. 2016-228762 filed on Nov. 25, 2016, including description, claims, drawings, and abstract the entire disclosure is incorporated herein by reference in its entirety.

BACKGROUND

Technological Field

The present invention relates to an image forming system, an image forming method, and a control program that form an image on a transfer medium, and an image reading apparatus that reads an image on a transfer medium.

Description of the Related Art

In a case where double-sided printing is performed by image forming apparatuses, image formation is performed on a front side of a paper in an image former, then the paper is reversed by a reversing mechanism, and on a back side of the reversed paper image formation is performed. However, in a case where double-sided printing is performed by one image forming apparatus, it is necessary to reserve a paper and to circulate the paper to an upstream side of the image former. Thus, productivity drops as compared with the case of performing one-sided printing.

For example, JP 2012-27099 A has been proposed as a technique for increasing productivity during double-sided printing. In JP 2012-27099 A, a plurality of image forming apparatuses are connected in series along a paper conveyance direction. Image formation is performed on a front side of a paper by an image forming apparatus in an earlier stage, then the paper is reversed, and image formation is performed on a back side of the paper by an image forming apparatus in a later stage.

Meanwhile, there is a case that a difference in paper length occurs in each paper in a paper bundle used in a job. In particular, occurrence frequency increases for manually-cut papers. In a case where double-sided printing is performed using a paper a paper length of which is different from that of other papers, disadvantageously, positions of formed images are misaligned between a front side and a back side, and problems such as misalignment of images between a front side and a back side occurs.

SUMMARY

The present invention has been devised in view of the above circumstances, and it is one of objects of the present invention to provide an image forming system, an image reading apparatus, an image forming method, and a control program capable of obtaining the length of a transfer medium by detecting the transfer medium and setting an appropriate image forming condition.

To achieve the abovementioned object, according to an aspect of the present invention, an image forming system reflecting one aspect of the present invention comprises:

an image former that performs image formation on a transfer medium; and a controller that acquires a detection result of detecting the transfer medium by a detector with respect to a length of the transfer medium, wherein the controller sets an image forming condition for the transfer medium on the basis of the length of the transfer medium obtained from the detection result.

BRIEF DESCRIPTION OF THE DRAWING

The advantages and features provided by one or more embodiments of the invention will become more fully understood from the detailed description given hereinbelow and the appended drawings which are given by way of illustration only, and thus are not intended as a definition of the limits of the present invention:

FIG. 3 is a diagram illustrating an example of a paper setting screen including a front and back adjustment field according to the embodiment of the present invention;

DETAILED DESCRIPTION OF EMBODIMENTS

Hereinafter, one or more embodiments of the present invention will be described with reference to the drawings. However, the scope of the invention is not limited to the disclosed embodiments.

First Embodiment

Figure 1:
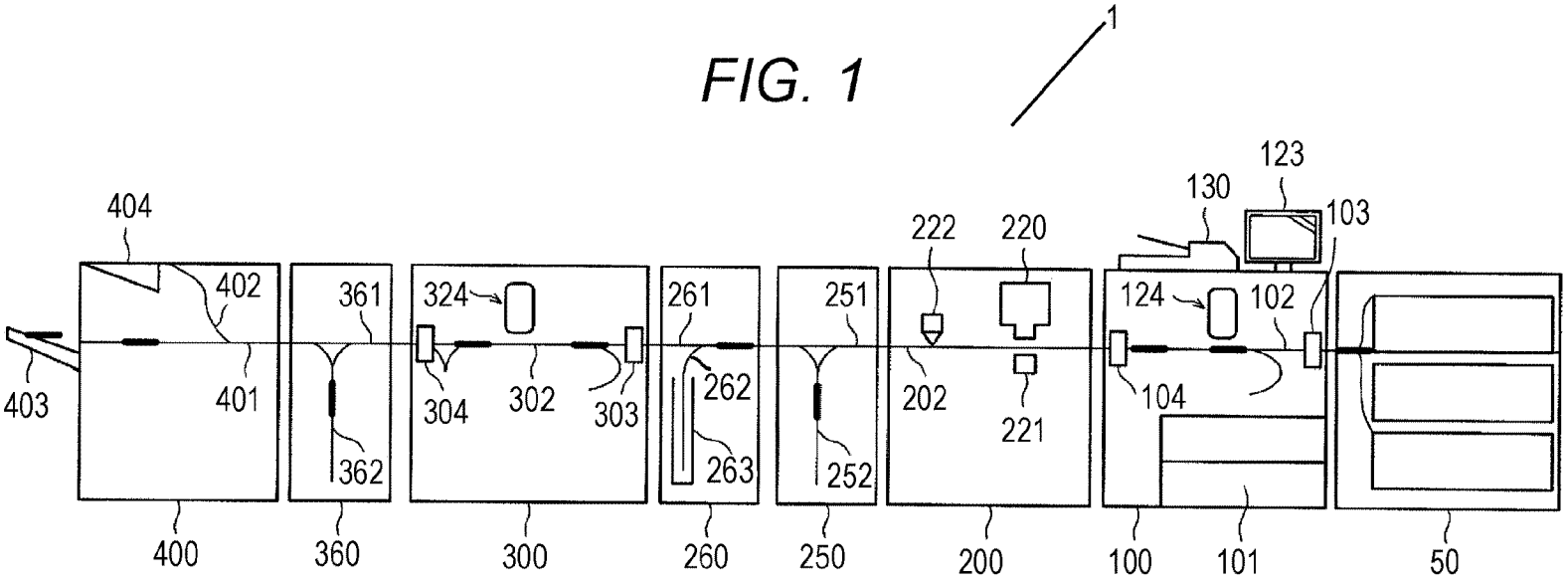
FIG. 1 is a diagram illustrating a mechanical outline of an image forming system according to an embodiment of the present invention.

FIG. 1 is a diagram illustrating a mechanical outline of an image forming system 1 according to an embodiment.

The image forming system 1 has a configuration in which a plurality of image forming apparatuses 100 and 300 is connected in series in tandem. The image forming system 1 includes a paper feeder (PFU) 50, a first image forming apparatus 100, an image reading apparatus 200, a first relay reverser (RU) 250, a relay paper ejector (TRU) 260, a second image forming apparatus 300, a second relay reverser 360, and a post-processing apparatus (FNS) 400 from an upstream side of a conveyance direction of papers. Each of the apparatuses is electrically and mechanically connected, and communication between each of the apparatuses is possible via a communicator not illustrated in FIG. 1. Papers can be conveyed sequentially from an apparatus in an earlier stage to an apparatus in a later stage.

In the image forming system 1, the first image forming apparatus performs printing on a first side which is a front side of a paper, the paper is reversed by the first relay reverser (RU) 250, and the second image forming apparatus 300 performs printing on a second side which is the opposite side to the front side, thereby enabling double-sided printing.

However, it is also possible to provide a mechanism for performing double-sided printing only by one of the first image forming apparatus 100 and the second image forming apparatus 300. In this embodiment, the first image forming apparatus 100 is referred to as a master device and the second image forming apparatus 300 is referred to as a slave device as appropriate.

The paper feeder (PFU) 50 has a plurality of paper feed trays, and papers of a sheet shape are accommodated in a paper feed tray. A paper in a paper feed tray is conveyed to a conveyance path 102 of the first image forming apparatus 100 through a paper feed path of the paper feeder (PFU) 50. Note that in this embodiment a paper corresponds to a transfer medium of the present invention. Note that in the present invention a transfer medium is not limited to a paper and may be made of plastic, cloth or other materials.

The first image forming apparatus 100 includes a paper feed tray 101, the conveyance path 102, a sensor 103, a sensor 104, and an image former 124 and further includes, in an upper part of a housing, an operation display 123 and a document feeder 130.

Papers are accommodated in the paper feed tray 101, and a paper in the paper feed tray 101 is fed to the conveyance path 102. In the conveyance path 102, a paper fed from the paper feeder (PFU) 50 or a paper fed from the paper feed tray 101 is conveyed.

The image former 124 is included in the middle of the conveyance path 102. The image former 124 includes a photoreceptor, a charger, an LD, a developing part, a transfer part, a fixer, and the like and is capable of forming an image on a paper on the conveyance path 102 by an electrographic method. In this embodiment, the image former 124 corresponds to a first image former of the present invention.

Note that the first image forming apparatus 100 may be any of a monochrome printer and a multicolor (color) printer.

In the first image forming apparatus 100, a reversing conveyance path (not illustrated) may bifurcate from the conveyance path 102 at a position on a downstream side of the image former 124. In this case, the reversing conveyance path merges with the conveyance path 102 on the upstream side of the image former 124. By reversing the paper through the reversing conveyance path, it is possible to print on both sides of the paper only by the first image forming apparatus 100.

The sensor 103 is included in the conveyance path 102 on the upstream side of the image former 124, and the sensor 104 is included in the conveyance path 102 on the downstream side of the image former 124. The sensors 103 and 104 detect paper edges of a paper conveyed in the conveyance path 102. The sensors 103 and 104 can be formed by an optical sensor and are capable of detecting a paper edge by ON/OFF of light detection.

The sensors 103 and 104 can be used as a transfer medium length measurer, that is, a detector of an embodiment of the present invention and are capable of continuous detection in accordance with conveyance of a paper. A controller to be described later is capable of acquiring detection results of a leading edge and a trailing edge of a paper and calculating a paper length from a time difference therebetween and the conveying speed. Note that, in the present embodiment, descriptions are given assuming that sensors are included; however in the present invention, it is also possible not to include the sensors.

The operation display 123 has an LCD including a touch panel and is capable of displaying information and accepting operation input. In this embodiment, the operation display 123 serves as both an operator and a display; however, the operator may be formed by a mouse, a tablet, or the like and may be formed separately from the display. Furthermore, the LCD may be movable.

The document feeder 130 automatically feeds a document. Reading of an image of a document to be fed can be performed by a scanner not illustrated in FIG. 1. The read image is accumulated in a memory or the like as image data and can be used for image formation. A document image may be read by arranging a document on a platen glass (not illustrated) and reading the document on the platen glass by a scanner.

The image reading apparatus 200 has a conveyance path 202 that communicates with the conveyance path 102 of the first image forming apparatus 100 and includes a reader 220, a calibrator 221, and a reader calibration sensor 222 along the conveyance path 202. The reader calibration sensor 222 is located on a downstream side of the reader 220 and the calibrator 221 in the conveyance direction. Note that in the following description the image reading apparatus is referred to as an ICCU as appropriate.

The image reader 220 has a line sensor having a length exceeding the width of a paper. The line sensor can be formed by an optical sensor such as a CCD, a CMOS, or the like. The reader 220 is capable of acquiring image data by scanning an image on a paper. The acquired image data corresponds to a reading result of the present invention. The reading result is transmitted to controller which will be described later via a communicator (not illustrated). Therefore, in this embodiment, the image reader 220 corresponds to the detector of the present invention.

The calibrator 221 can be formed by a rotating background plate or the like and transmits the reading result of the reader 220 in accordance with a rotational position of the rotating background plate to an image controller which will be described later. In the image controller, the reader 220 is calibrated by the reading result corresponding to operation of the calibrator 221. Furthermore, the reader calibration sensor 222 can be formed by a colorimeter or the like with a high detection precision. A reading result of the reader calibration sensor 222 and the reading result of the reader 220 are transmitted to the image controller, and the image controller calibrates the reader 220 from a relationship between the results. The conveyance path 202 of the image reading apparatus 200 is connected to a conveyance path 251 of the first relay reverser (RU) 250.

The first relay reverser (RU) 250 has the conveyance path 251 that communicates with the conveyance path 202 of the image reading apparatus 200. The conveyance path 251 bifurcates into a reversing conveyance path 252 in the middle thereof and on the downstream side thereof the reversing conveyance path 252 joins the conveyance path 251. The reversing conveyance path 252 can reversed a paper by a switchback, and the reversed paper can be conveyed by returning the paper from the reversing conveyance path 252 to the conveyance path 251 on the downstream side.

The reversed paper is conveyed to the second image forming apparatus 300 with a front side (first side) formed with the image in the first image forming apparatus 100 facing down and a back side (second side) on the opposite side of the front side facing up, thereby enabling forming an image on the second side.

The conveyance path 251 also has a path for directly conveying a paper without reaching the reversing conveyance path 252. The conveyance path 251 is connected to a conveyance path 261 in the relay paper ejector (TRU) 260.

The relay paper ejector (TRU) 260 has the conveyance path 261 communicating with the conveyance path 251, and the conveyance path 261 bifurcates into a conveyance path 262 in the middle thereof. The conveyance path 262 is connected to a paper ejector 263, and for example, it is possible to send a paper determined as a waste paper by the image reading apparatus 200 to the conveyance path 262 and to eject the paper as a waste paper to the paper ejector 263. This enables preventing an unnecessary waste paper from being conveyed to the downstream side. Note that a normal paper is conveyed to the downstream side by the conveyance path 261 without reaching the conveyance path 262. The conveyance path 261 is connected to a conveyance path 302 of the second image forming apparatus 300.

The second image forming apparatus 300 has the conveyance path 302 that communicates with the conveyance path 261 and is arranged with a sensor 303, an image former 324, and a sensor 304 on the conveyance path 302 in the order mentioned from the upstream side in the conveyance direction. The image former 324 includes a photoreceptor, a charger, an LD, a developing part, a transfer part, a fixer, and the like and is capable of forming an image on a paper at a predetermined position on the conveyance path 302 by an electrographic method. In this embodiment, the image former 324 corresponds to a second image former of the present invention.

Note that the second image forming apparatus may be any one of a monochrome printer and a multicolor (color) printer. The first image forming apparatus and the second image forming apparatus described above may be of different types in terms of a monochrome printer and a multicolor printer.

In the second image forming apparatus 300, a reversing conveyance path (not illustrated) may bifurcate from the conveyance path 302 at a position on a downstream side of the image former 324. In this case, the reversing conveyance path merges with the conveyance path 302 on the upstream side of the image former 324. By reversing the paper through the reversing conveyance path, it is possible to print on both sides of the paper only by the second image forming apparatus 300.

The sensor 303 is included in the conveyance path 302 on the upstream side of the image former 324, and the sensor 304 is included in the conveyance path 302 on the downstream side of the image former 324. The sensors 303 and 304 detect a paper edge of a paper conveyed in the conveyance path 302. The sensors 303 and 304 can be formed by an optical sensor and detect a paper edge by ON/OFF of light detection. The detection can be continuously performed in accordance with conveyance of a paper.

The sensors 303 and 304 can be used as the transfer medium length measurer, that is, the detector of the present invention. A controller to be described later is capable of acquiring detection results of a leading edge and a trailing edge of a paper and calculating a paper length from a time difference therebetween and the conveying speed. Note that, in the present embodiment, descriptions are given assuming that sensors are included; however in the present invention, it is also possible not to include the sensors.

The second relay reverser (RU) 360 has a conveyance path 361. The conveyance path 361 bifurcates into a reversing conveyance path 362 in the middle thereof and on the downstream side thereof the reversing conveyance path 362 joins the conveyance path 361. The reversing conveyance path 362 can reverse a paper by a switchback, and the reversed paper can be conveyed by returning the paper from the reversing conveyance path 362 to the conveyance path 361 on the downstream side. The conveyance path 361 also has a path for directly conveying a paper without reaching the reversing conveyance path 362. The conveyance path 361 is connected to a conveyance path 402 of the post-processing apparatus (FNS) 400.

The post-processing apparatus (FNS) 400 has a conveyance path 401 communicating with the conveyance path 361, and the post-processing apparatus (FNS) 400 has a post-processor (not illustrated) communicating with the conveyance path 401. In the post-processor, it is possible to perform desired post-processing on a paper. Examples of post-processing include appropriate processing such as stapling, punching, and booklet processing. In the present invention, the type of post-processing is not particularly limited.

The conveyance path 401 bifurcates into a conveyance path 402 in the middle thereof. A paper conveyed in the conveyance path 401 is ejected to a paper eject tray 403, and a paper conveyed by the conveyance path 402 is ejected to a paper eject tray 404.

Note that in the above description, descriptions are given assuming that the image forming system 1 includes the paper feeder (PFU) 50, the first image forming apparatus 100, the image reading apparatus 200, the first relay reverser (RU) 250, the relay paper ejector (TRU) 260, the second image forming apparatus 300, the second relay reverser (RU) 360, and the post-processing apparatus (FNS) 400. However, the number and the type of apparatuses forming an image forming system of the present invention are not limited to those described above, and another apparatus may be further connected, or three or more image forming apparatuses may be included.

In the image forming system 1 of this embodiment, descriptions are given assuming that the plurality of image forming apparatuses are connected in tandem in series; however, the present invention is not limited to the configuration of the tandem connection in series. A plurality of image formers may be included in one image forming apparatus, or one image former may be included in one image forming apparatus.

Furthermore, in the above, descriptions are given assuming double-sided printing; however, the present invention can also be applied to cases where double-sided printing is not performed. Acquiring a detected paper length enables for appropriately setting an image forming condition which will be described later, which enables ejecting a waste paper, clipping an image, an affine change to accommodate an image in an image forming area of a transfer medium.

In the above configuration, the sensors 103 and 104 are included in the first image forming apparatus 100, and the sensors 303 and 304 are included in the second image forming apparatus 300; however, arrangement of the sensor is not limited to this, and the sensors may be arranged in another apparatus. For example, the sensors may be included in the paper feeder (PFU) 50 or in the first relay reverser (RU) 250.

In the above configuration, the image reader is included in the image reading apparatus between the first image forming apparatus and the second image forming apparatus; however in the present embodiment, the image reader may be included on a paper feed side or a paper eject side inside or outside the first image forming apparatus, on a paper feed side inside or outside the second image forming apparatus, or inside the first relay reverser (RU) 250.

Figure 2A:
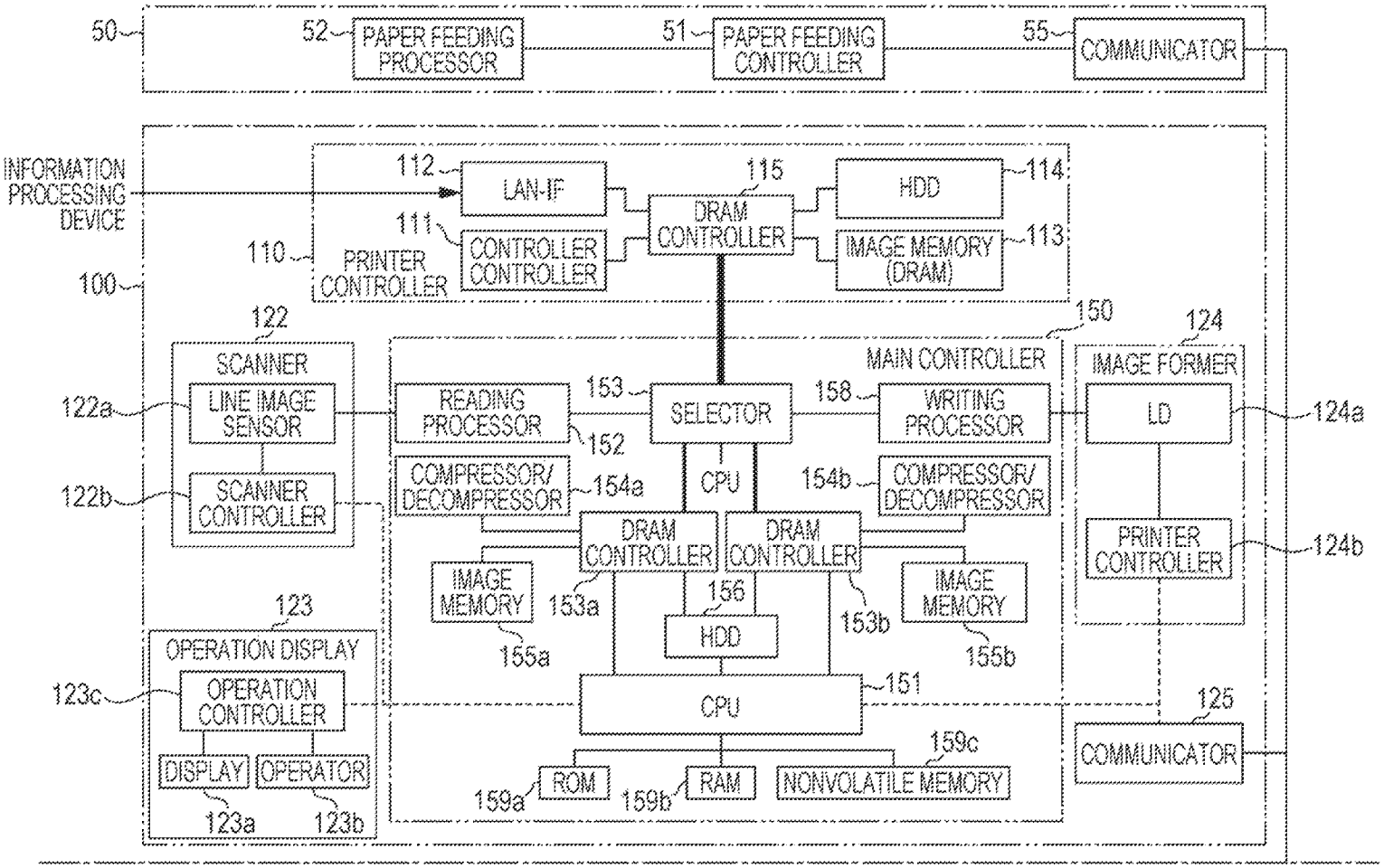
FIGS. 2A and 2B are a diagram illustrating an outline of electrical blocks according to the embodiment of the present invention.
Figure 2B:
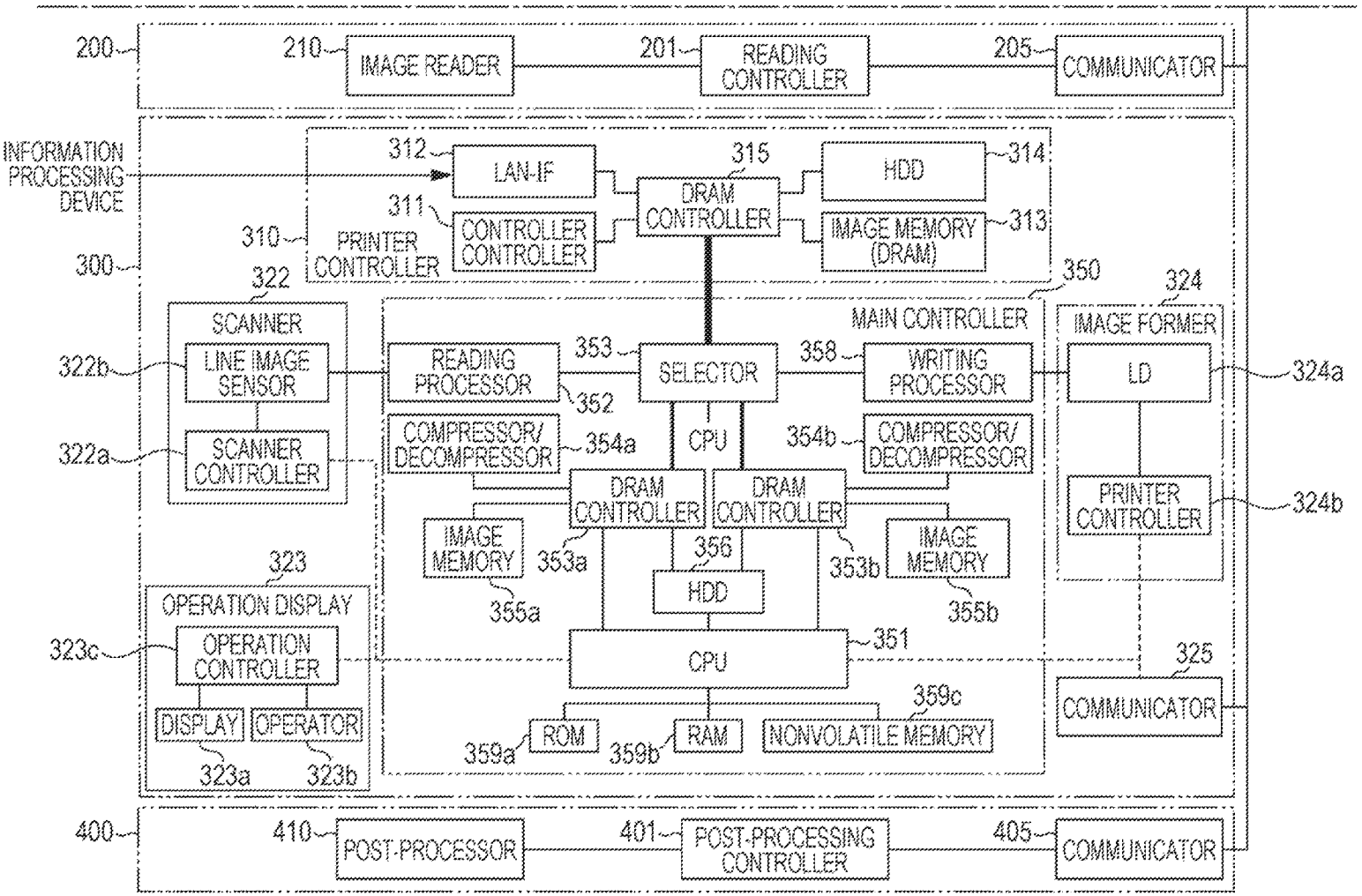

Next, an electrical configuration of the image forming system 1 will be described with reference to FIG. 2.

First, the paper feeder (PFU) 50 will be described.

The paper feeder (PFU) 50 includes a paper feeding controller 51, a paper feeding processor 52, and a communicator 55. The paper feeding controller 51 is formed by a storage such as a CPU, a ROM, and a RAM and a program or the like operated by a CPU and controls the paper feeder (PFU) 50. The paper feeding controller 51 can be subjected to control from a controller of another apparatus via the communicator 55. The paper feeding processor 52 is formed by a conveyance roller or the like and is capable of conveying a paper on the basis of control received from the paper feeding controller 51.

Next, the first image forming apparatus 100 will be described.

The first image forming apparatus 100 mainly includes a printer controller 110, a scanner 122, an operation display 123, an image former 124, a communicator 125, and a main controller 150.

The printer controller 110 includes a controller controller 111, a LAN-IF 112, an image memory (DRAM) 113, an HDD 114, and a DRAM controller 115.

The controller controller 111 includes a CPU, a ROM, a RAM, and the like and controls the printer controller on the basis of a program operated by the CPU. The LAN-IF 112 is coupled to an information processor such as a PC outside the image forming system 1 and is capable of communicating with the information processor coupled to a network or the like.

When image data for printing is acquired by the first image forming apparatus 100, the image data can be received via the LAN-IF 112. The received image data is stored in the image memory (DRAM) 113 or the HDD 114 via the DRAM controller 115.

The DRAM controller 115 is connected to the controller controller 111, the LAN-IF 112, the image memory (DRAM) 113, and the HDD 114. The DRAM controller 115 is connected to a selector 153 of the main controller 150 via PCI bus.

The scanner 122 includes a line image sensor 122*a* and a scanner controller 122*b*. The line image sensor 122*a* and the scanner controller 122*b* are electrically connected to each other, and the scanner controller 122*b* controls the line image sensor 122*a* to optically read an image on a document.

The line image sensor 122*a* is connected to a reading processor 152 of the main controller 150, and the scanner controller 122*b* is connected to a CPU 151 of the main controller 150.

The operation display 123 has a display 123*a*, an operator 123*b*, and an operation controller 123*c*. The display 123*a* can be formed by an LCD, and the operator can be formed by a touch panel, an operation button outside the LCD, or the like. The operation controller 123*c* is formed by a CPU, a ROM, a RAM, a program operating on the CPU, and the like and controls the operation display 123. The operation display 123 enables displaying a setting screen or an operation screen, displaying a warning, notifying a user, accepting operation input, and the like.

The image former 124 includes an LD 124*a* and a printer controller 124*b* as well as a charger, a photoreceptor, a developing part, a transfer part, a fixer, and the like (not illustrated). The printer controller 124*b* can control the entire image former 124, and the printer controller 124*b* controls each of the parts according to a command from the CPU 151 to form an image. In a case of performing image formation, the LD 124*a* forms a latent image on the photoreceptor on the basis of the image data, the developing part develops the latent image to create a toner image, the transfer part transfers the toner image to a paper, and the fixer fixes the toner image on the paper by heat or the like. Note that the image former may be one that performs monochrome printing or one that performs color printing.

Next, the main controller 150 will be described. The main controller 150 controls the first image forming apparatus 100. The main controller 150 includes a CPU 151, a reading processor 152, a selector 153, DRAM controllers 153*a* and 153*b*, compressor/decompressors 154*a* and 154*b*, image memories 155*a* and 155*b*, an HDD 156, a writing processor 158, a ROM 159*a*, a RAM 159*b*, and a nonvolatile memory 159*c*.

The CPU 151 controls the entire first image forming apparatus 100 by executing a program to grasp the state of the entire first image forming apparatus 100. The CPU 151 and the program operated by the CPU 151 function as an image controller. The program includes a control program of the present invention. The program may be stored in the ROM 159*a* or may be stored in the HDD 156 or an external storage medium. The program may be one which can be distributed by removing a storage medium.

The image controller of the present invention is capable of receiving detection results of the sensors 103, 104, 303, and 304 or/and the image reader 220 and calculating the paper length to set an image forming condition.

Note that in this embodiment, the image controller that controls the entire image forming apparatus functions as a controller that calculates the paper length. However, a controller that calculates the paper length may be included separately from the image controller that controls the entire image forming apparatus.

The controller is not particularly limited of installation location and may be installed outside each of the apparatuses of the image forming system.

In the first image forming apparatus 100, the image forming condition set on the basis of the paper length is transmitted to the second image forming apparatus 300 via the communicator 125. In the second image forming apparatus 300, a corresponding image formation condition is applied to a paper before printing.

The RAM 159*b* can be used as a work memory when the CPU 151 executes the program, and the nonvolatile memory 159*c* stores user data, system data, paper setting, operation parameters, various setting values, and the like. The nonvolatile memory 159*c* stores various parameters necessary for determining paper length and determining an image formation position, which will be described later, front and back adjustment values, data of measured paper length, and the like.

The reading processor 152 performs predetermined processing on data acquired by the scanner 122. For example, the reading processor 152 performs various types of processing such as analog signal processing, analog to digital (A/D) conversion processing, and shading processing on an analog image signal input from the scanner 122, for example, to generate digital image data and outputs the data to the selector 153.

The selector 153 selects one of the DRAM controller 153*a* and the DRAM controller 153*b* on the basis of a command from the CPU 151. This can be selected depending on whether data is read or written.

In addition, the selector 153 is connected to the DRAM controller 115 of the printer controller 110 via PCI bus, and data can be transmitted and received between the printer controller 110 and the main controller 150.

The DRAM controller 153*a* controls writing of data to the image memory 155*a* and reading of data from the image memory 155*a* and also performs control at the time of compressing or decompressing image data in the compressor/decompressor 154*a*.

The DRAM controller 153*b* controls writing of data to the image memory 155*b* and reading of data from the image memory 155*b* and also performs control at the time of compressing or decompressing image data in the compressor/decompressor 154*b*.

The compressor/decompressors 154*a* and 154*b* are capable of compressing image data and decompressing compressed image data. Compressed or decompressed data is stored in the image memory 155*a* or the image memory 155*b*.

Data (job data), image data, setting data, and the like of a print job received from the printer controller 110 are stored in the HDD 156. The HDD 156 and the nonvolatile memory 159*c* can be used as a storage of the present invention.

The writing processor 158 outputs a signal for controlling the LD 124*a* of the image former 124 in accordance with the image data read from the image memory 155*a* or the image memory 155*b* and decompressed.

Next, an electrical configuration of the image reading apparatus 200 will be described.

The image reading apparatus 200 includes a reading controller 201, a communicator 205, and an image reader 210. The reading controller 201 includes a CPU, a ROM, a RAM, and the like and is capable of controlling each of the parts of the image reading apparatus 200 by a program operated by the CPU.

The image reader 210 is formed by a reader, a conveyor, and the like and is capable of reading an image on a paper under the control of the reading controller 201. The image reader 220 is capable of continuously reading an image of a conveyed paper. Furthermore, the reading controller 201 can be subjected to external control via the communicator 205 and transmits a read image acquired via the communicator 205 to the first image forming apparatus 100 or the second image forming apparatus 300. In the first image forming apparatus 100 and the second image forming apparatus 300, the paper length can be calculated using the read image acquired by the image reading apparatus 200. Furthermore, it is possible to adjust density balance of an image, edge density, line width, maximum density, front and back image formation positions, and the like.

Note that in this embodiment, the controller included in the first image forming apparatus calculates the paper length. However, the paper length may be calculated in the image reading apparatus. In this case, the reading controller 201 can perform the calculation. The reading controller 201 may be included and the calculation result may be transmitted to the first image forming apparatus 100 or the second image forming apparatus 300 via the communicator 205. Furthermore, the above operation may be performed by a controller included in the second image forming apparatus.

Next, an electrical configuration of the second image forming apparatus 300 will be described.

The second image forming apparatus 300 mainly includes a printer controller 310, a scanner 322, an operation display 323, an image former 324, a communicator 325, and a main controller 350.

The printer controller 310 includes a controller controller 311, a LAN-IF 312, an image memory (DRAM) 313, an HDD 314, and a DRAM controller 315. These configurations are similar to the configuration of the printer controller 110 in the first image forming apparatus 100, and similar operations are performed, and thus details are omitted. Note that in the second embodiment, the printer controller 310 may not be included.

The scanner 322 has a line image sensor 322*a* and a scanner controller 322*b*. The line image sensor 322*a* and the scanner controller 322*b* are electrically connected, and the scanner controller 322*b* controls the line image sensor 322*a*.

The line image sensor 322*a* is connected to a reading processor 352 of the main controller 350, and the scanner controller 322*b* is connected to a CPU 351 of the main controller 350.

Note that in the second image forming apparatus 300, the scanner 322 may not be included.

The operation display 323 has a display 323*a*, an operator 323*b*, and an operation controller 323*c*. The display 323*a* can be formed by an LCD, and the operator can be formed by a touch panel, an operation button outside the LCD, or the like. The operation controller 323*c* is formed by a CPU, a ROM, a RAM, a program operating on the CPU, and the like and controls the operation display 323.

The operation display 323 enables displaying a setting screen or an operation screen, displaying a warning, notifying a user, accepting operation input, and the like. Note that in the second image forming apparatus, the operation display 323 may not be included. In that case, setting or display of the second image forming apparatus 300 may be performed via the operation display 123 of the first image forming apparatus 100.

The image former 324 includes an LD 324*a* and a printer controller 324*b* as well as a charger, a photoreceptor, a developing part, a transfer part, a fixer, and the like (not illustrated). The printer controller 324*b* controls the entire image former 124. The printer controller 324*b* controls each of the parts according to a command from the CPU 351 to form an image. The operation of the image former 324 is similar to that of the image former 124 of the first image forming apparatus 100.

The main controller 350 controls the second image forming apparatus 300. The main controller 350 includes the CPU 351, the reading processor 352, a selector 353, DRAM controllers 353*a* and 353*b*, compressor/decompressors 354*a* and 354*b*, image memories 355*a* and 355*b*, an HDD 356, a writing processor 358, a ROM 359*a*, a RAM 359*b*, and a nonvolatile memory 359*c*.

The CPU 351 controls the entire second image forming apparatus 300 by executing a program to grasp the state of the entire second image forming apparatus 300. The CPU 351 and the program operated by the CPU 351 can function as an image controller. The program includes a control program of the present invention. The program may be stored in the ROM 359*a* or may be stored in the HDD 356 or an external storage medium. The program may be one which can be distributed by removing a storage medium.

The image controller of the present invention is capable of receiving detection results of the sensors 103, 104, 303, and 304 or/and the image reader 220 and calculating the paper length to set an image forming condition. In this embodiment the image controller that controls the entire image forming apparatus functions as a controller that calculates the paper length. However, a controller that calculates the paper length may be included separately from the image controller.

The RAM 359*b* can be used as a work memory when the CPU 351 executes the program, and the nonvolatile memory 359*c* stores user data, system data, paper setting, operation parameters, various setting values, and the like. The nonvolatile memory 359*c* stores various parameters necessary for determining paper length and determining an image formation position, which will be described later, front and back adjustment values, data of measured paper length, and the like.

The reading processor 352 performs predetermined processing on data acquired by the scanner 322. For example, the reading processor 352 performs various types of processing such as analog signal processing, analog to digital (A/D) conversion processing, and shading processing on an analog image signal input from the scanner 322, for example, to generate digital image data and outputs the data to the selector 353.

The selector 353 selects one of the DRAM controller 353*a* and the DRAM controller 353*b* on the basis of a command from the CPU 351. This can be selected depending on whether data is read or written.

In addition, the selector 353 is connected to the DRAM controller 315 of the printer controller 310 via PCI bus, and data can be transmitted and received between the printer controller 310 and the main controller 350.

The DRAM controller 353*a* controls writing of data to the image memory 355*a* and reading of data from the image memory 355*a* and also performs control at the time of compressing or decompressing image data in the compressor/decompressor 354*a*.

The DRAM controller 353*b* controls writing of data to the image memory 355*b* and reading of data from the image memory 355*b* and also performs control at the time of compressing or decompressing image data in the compressor/decompressor 354*b*.

The compressor/decompressors 354*a* and 354*b* are capable of compressing image data and decompressing compressed image data. Compressed or decompressed data is stored in the image memory 355*a* or the image memory 355*b*.

Data (job data), image data, setting data, and the like of a print job received from the printer controller 310 are stored in the HDD 356. The HDD 356 and the nonvolatile memory 359*c* can be used as a storage of the present invention.

The writing processor 358 outputs a signal for controlling the LD 324*a* of the image former 324 in accordance with the image data read from the image memory 355*a* or the image memory 355*b* and decompressed.

Next, an electrical configuration of the post-processing apparatus (FNS) 400 will be described.

The post-processing apparatus (FNS) 400 has a post-processing controller 401, a communicator 405, and a post-processor 410. The post-processing controller 401 includes a CPU, a ROM, a RAM, and the like and controls each of the parts of the post-processing apparatus (FNS) 400 by a program operated by the CPU. The post-processor 410 is capable of performing predetermined post-processing on a conveyed paper. The post-processing controller 401 is capable of transmitting and receiving data via the communicator 405.

Next, real-time front and back adjusting operation accompanying the operation of the embodiment of the present invention will be described. Note that in the following description, image formation is performed on a front side of a paper by the first image forming apparatus 100, which is a master device, and image formation is performed on a back side of the front side by the second image forming apparatus 300 which is a slave device. Furthermore in this embodiment, it is assumed that the paper length of a paper subjected to image formation is detected by the image reader 220.

When double-sided printing is performed in an image forming apparatus, it is general to set front and back adjustment in order to prevent positional shift between front and back images.

FIG. 3 is a diagram illustrating an example of a paper setting screen 1400 displayed on an operation display of an image forming apparatus. As displayed in the front and back adjustment field 1401 of the paper setting screen 1400, it is possible to align positions of images on both sides by performing magnification setting and image shift adjustment of a front side and a back side and registering set values in a paper profile. In addition, it is also possible to set to perform periodic adjustment for every predetermined number of papers (for example, 100 papers at the minimum) as a periodic adjustment function.

In a configuration in which a sensor or an image reader are included between the master device and the slave device in series in tandem, it is possible to prevent misalignment between the front side and the back side by detecting an edge of a paper or a register mark before printing by the slave device and immediately reflecting this.

However, papers accommodated in a paper feed tray may contain a paper having a different paper length with or without intention. For example with manually-cut papers, variations in paper length are likely to occur.

At that time in the sensor or the image reader that detects an edge of a paper and a register mark, it is relatively easy to perform front and back sides adjustment without being affected by the paper length by printing in the main scanning direction with position adjustment by aligning using one side as a reference as long as a physical paper length is available. In a sub-scanning direction which is a conveyance direction of a paper, however, when adjustment is made from the edge of the paper to the register mark on the front side by the current front and back adjustment method, a leading edge and a trailing edge are switched due to reversing and thus misalignment in the front side and the back side occurs. Therefore, in the case where a paper having a different length is included, if the paper is fed and double-sided printing is performed, misalignment of images in the front side and the back side disadvantageously occurs in the paper having a different paper length.

Referring to variations in the paper length of actually detected papers, there is a large deviation from a design value in a direction that is the paper conveyance direction.

When waste papers are determined with a criteria of a threshold value of ±zero comma several millimeters, several waste papers are detected in several thousands of papers. These occur due to unexpected differences in individual paper lengths and thus cannot be eliminated by the front and back adjustment method of the related art, resulting is disposal as waste papers.

In the present embodiment, the paper length is detected, and the image forming condition is determined on the basis of the paper length.

The paper length may be a length over the entire length in the conveyance direction or a length of a part of the paper. Alternatively, a distance between a specific position for example a register mark and another position may be set as the paper length.

Specifically, in this embodiment, specifically, an image formation position in the second image forming apparatus that prints an image on the second side opposite to the first side having printed previously is determined. If the image formation position is determined by an apparatus other than the second image forming apparatus, the image formation position is transmitted to the second image forming apparatus before printing an image on the back side. In the second image forming apparatus, image formation is performed on the basis of this image formation position. When the image formation position is determined by the second image forming apparatus, printing on the back side of the paper is performed in accordance with the image formation position. In this case, a detection result may be acquired by the first image forming apparatus to calculate the paper length, and the image formation position may be determined by the first image forming apparatus on the basis of the result. Alternatively, the calculated paper length may be transmitted to the second image forming apparatus, and the image formation position may be determined by the second image forming apparatus. In this case, the controller of the first image forming apparatus and the controller of the second image forming apparatus cooperate to fulfill the function of the controller of the present invention.

Note that in the above description, the paper length can be calculated either by detection by a sensor or detection by image reading by an image reader, but each method has its own characteristic.

It is possible to determine the print start position as the image formation position by calculating the paper length using a single or multiple pieces of detection information and a communication part such as the transfer medium length measurer and the image reader. For example, in a case where a detector is attached to the conveyance path, the detector may be attached to a feeding start position, a post-fixing position where paper shrinkage is expected, or other positions.

In a serial tandem, the master device and the slave device usually has the same sensor configuration. However, due to dependence on the attachment location of the sensor at the paper feed start position and the shape of the conveyance path, there is a possibility that measurement cannot be performed on the paper feed side before the slave device starts printing, or that productivity drops due to measurement. Therefore, it is desirable to measure by a sensor at a post-fixing position of the master device. However, there is a possibility that a sensor measurement value is affected due to thermal effects of fixing itself or of a paper after fixing, and thus it is desirable to consider an attachment position or design of the main body.

Since the serial tandem has setting of a configuration of a plurality of option components, a paper length measurement option may be inserted between the master device and the slave device. For example, in a case of conveying to the slave device without reversing a paper in the master device and targeting a reversing option, it is necessary to attach a sensor to the reversing option and to design a part that communicates the detected paper length information to the slave device. Moreover, configuration restrictions such as order of options also occur. Considering whether it is possible to detect the paper length by changing control software when there is the reversing option already attached with a color density sensor, since the sensor is a line sensor for color density adjustment, the sensor is assumed to be used on a chart paper designed to be resistant to an inclination of a paper, and it is not possible to correct the inclination due to conveyance effects which is indispensable for paper length detection. Therefore, there is a high possibility that the paper length becomes inaccurate even if an algorithm of control software is devised. Thus, there is a high possibility that the algorithm cannot be used for paper length detection.

It is possible to clear problems that are difficult to handle by the above methods by arranging an image reader normally on a paper eject side of the slave device and arranging an image reader on a paper eject side of the master device as an ICCU for use in detection of a waste paper and color density adjustment for utilization as prevention of waste papers.

An ICCU is not affected by the heat since an image is used, a measurement value is accurate due to an algorithm, and an attachment position thereof is only required to be between the master device and the slave device, and thus there is no need to consider the attachment position. In addition, it is possible to prevent waste papers by updating software for waste paper detection, and furthermore the paper length measurement algorithm can be changed/added in various manners (e.g., changing paper edge detection algorithm to register mark position detection algorithm). It is thus possible to increase the precision specialized in accordance with a user's request. Especially for users who purchase ICCU for detection of waste papers, there is no need to remodel the main body, and thus there is an advantage that it is possible to provide a new function only by moving the ICCU.

However, for the color density adjustment, ingenuity is necessary for the slave device side. This can be substituted by, for example, storing data on temporal change in advance in a case where printing is continued with respect to the color density of the master device and the slave device, measuring the print density of the master device to be compared with the stored data, and predicting a printing result of the slave device. Therefore, a method can be employed which corrects an ICCU scanned image, measures the length of a paper area, and determines a print start position of the slave device on the basis of a difference between a trailing edge of the image and a trailing edge of the paper and a front and back adjustment value.

Furthermore, it is possible to measure the lengths of all the papers to be printed by ICCU scan and to store length information in a storage medium in association with pages. A scanned paper is returned to the master device, and the associated storage information is read correctly at the time of printing to perform printing. Furthermore, the image reader in this case may perform a cooperative operation with the aforementioned sensor or an apparatus with the paper length measuring function attached to a mass paper feed option.

Figure 4:
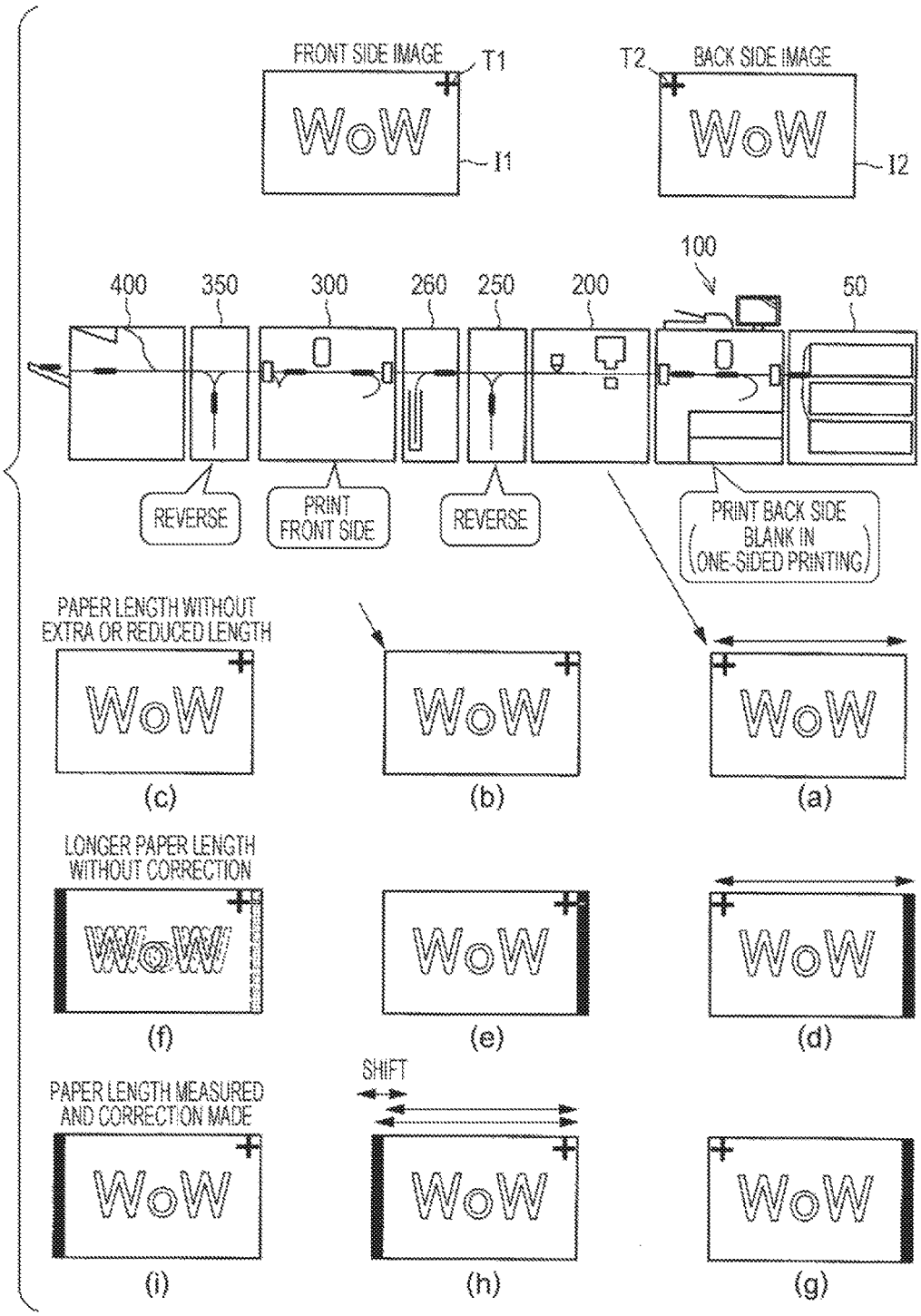
FIG. 4 is a diagram explaining a comparison among a paper without extra or reduced length, a longer paper, and a case where writing position adjustment according to the present embodiment is performed on a longer paper in an image forming system.

FIG. 4 is a diagram explaining occurrence of misalignment between a front side and a back side on the basis of a difference in paper lengths and a state of misalignment between a front side and a back side when the paper length is measured and thereby corrected.

In FIG. 4, face-up output is displayed to facilitate understanding of a printed surface.

In this explanation, a back side image I2 is printed on a front side (first side) of a paper by the first image forming apparatus 100, the paper is then reversed by the reverser 250, and a front side image I1 is printed on a second side of the paper which is the opposite side to the front side by the second image forming apparatus 300. A register mark T1 for positioning is formed in upper right on the front side image I1, and a register mark T2 for positioning is formed on the left side of the paper on the back side image I2.

In FIG. 4, (a), (b), and (c) illustrate a case where the paper length includes no extra or reduced length and the paper length is a prescribed size in accordance with a design value.

In the case where the paper length is the prescribed size, as illustrated in (a) of FIG. 4, the back side image I2 is formed at a proper position on the first side of the paper by the first image forming apparatus 100. Thereafter, the front side image I1 is printed on the second side of the reversed paper by the second image forming apparatus 300 as illustrated in (b) of FIG. 4. In this case, when the final output material is seen from the second side, image positions on the front side and the back side of the paper coincide without misalignment as illustrated in (c) of FIG. 4.

On the other hand, in a case where printing is performed on a paper longer than the design value by the method of the related art, as illustrated in (d) of FIG. 4, a black part has a length excessive to the design value. In a case where the first image forming apparatus 100 prints the back side image I2 on a first side of this paper, an image is formed in accordance with a distance on a leading edge of the paper. Thereafter, in a case where the paper is reversed and the front side image is printed on a second side, as illustrated in (e) of FIG. 4, an edge which has previously been the trailing side in the conveyance direction is located on the leading side, whereby image formation is performed in accordance with a distance on the leading edge side of the paper. Since the leading edge and the trailing edge in the conveyance direction are switched by reversing the paper, in (f) of FIG. 4 viewing the final output material from the second side, positional misalignment occurs in the conveyance direction between the images on the front side and the back side.

On the other hand in the present embodiment, as illustrated in (g) of FIG. 4, the back side image I2 is formed on a first side of the paper longer than the design value by the first image forming apparatus 100, the paper is detected (image reading) by the ICCU, and then the paper length is calculated. As illustrated in (h) of FIG. 4, there is a shift from the design value in the paper length. An image start position is corrected on the basis of the paper length ((h) of FIG. 4). The paper is reversed, and the front side image I1 is printed on a second side on the basis of the image start position corrected by the second image forming apparatus 300. In the final output item ((i) of FIG. 4), image positions on the front side and the back side of the paper coincide, and occurrence of misalignment between the front side and the back side is prevented.

Figure 5:
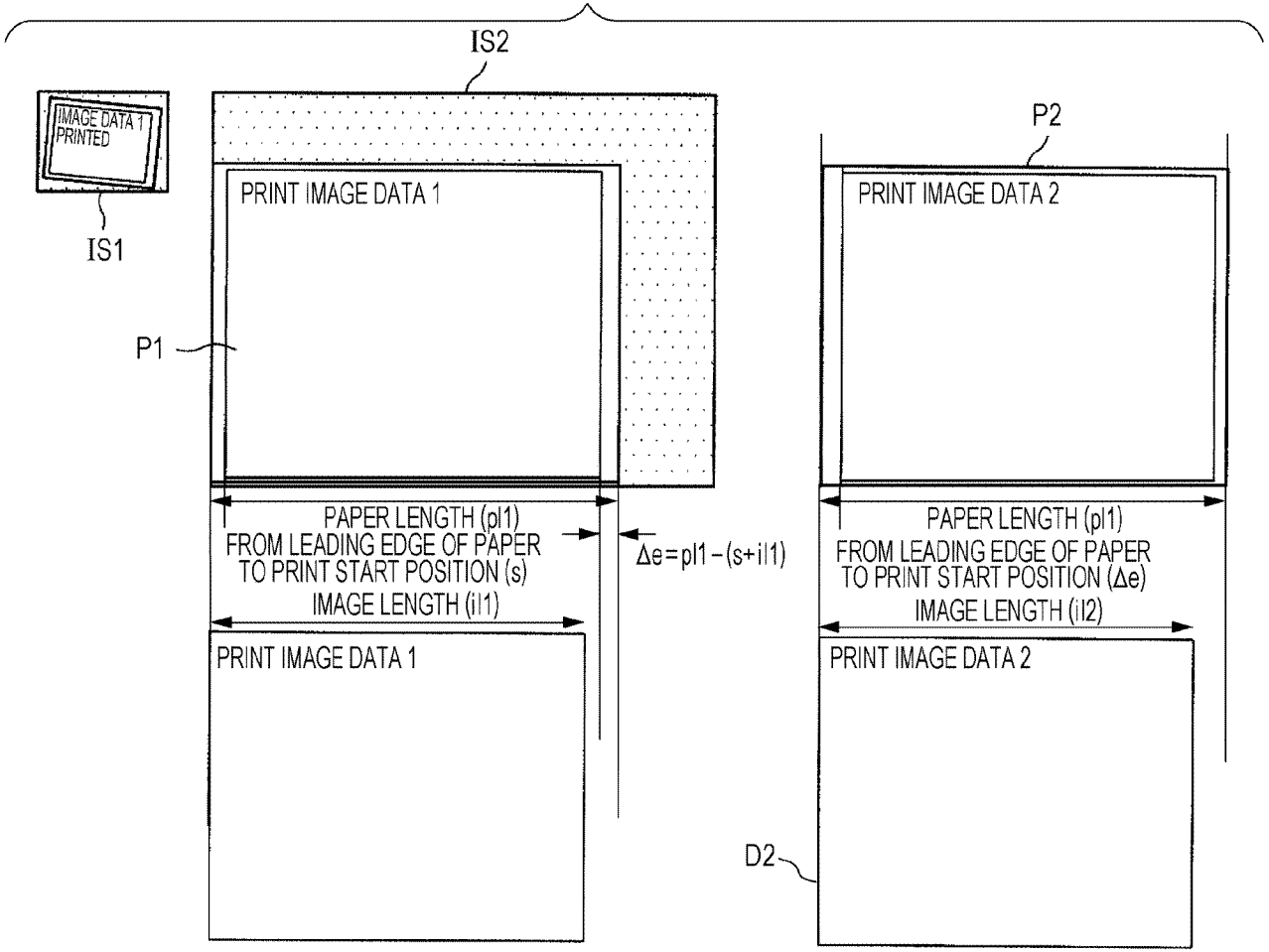
FIG. 5 is a diagram explaining a procedure of determining a print start position of a second side on the basis of a paper length calculated from a scanned image of a paper in an embodiment of the present invention.

FIG. 5 is a diagram illustrating an example of a case where the paper length is calculated on the basis of a reading result acquired by the image reading apparatus 200, and a print start position in the slave device is determined on the basis of the calculated paper length. Note that a dotted part around a scanned image is an image obtained from a background plate.

The image reading apparatus 200 reads the first side of the paper on which the printing has been performed by the master device to acquire the scanned image IS1. Thereafter, the inclination or position of a paper image included in the scanned image IS1 is corrected to acquire a scanned image IS2 including the first side image P1. A paper length (pl1) is measured using the scanned image IS2. By subtracting the image length (il1) after magnifying the front side and the back side and the print start position (s) from the paper length (pl1), as expressed in the following mathematical formula, a length Δe from a trailing edge of the first side image P1 to a trailing edge of the paper is calculated. The image length il1 and the print start position (s) can be acquired from job data for printing.

$$\Delta e = pl1 - (s + il1) \qquad \text{Mathematical Formula}$$

Next, processing for aligning the print start position after reversing the paper to the slave device is performed.

Printing in the slave device is performed with the calculated Δe used as the distance from a leading edge of the paper to the print start position of the image when the print image data D2 is printed on the second side P2 of the paper. This enables preventing misalignment of positions the images on the front side and the back side of the paper.

The calculation of Δe and the changing of the image formation position can be performed by receiving the paper length by the second image forming apparatus which is the slave device; however, a controller of another apparatus in the image forming system 1 may calculate Δe. For example, the reading controller 201 in the image reading apparatus 200 may calculate Δe and determine the image formation position to transmit the result to the second image forming apparatus 300.

Figure 6:
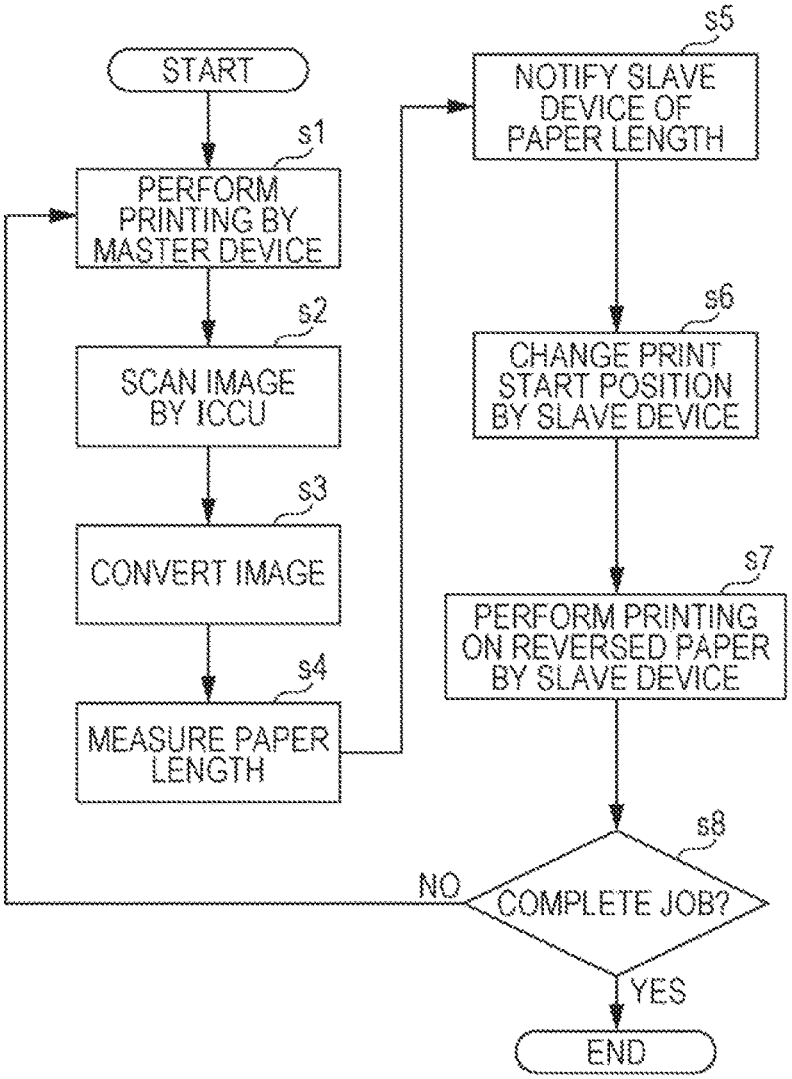
FIG. 6 is a flowchart illustrating a procedure of determining the print start position on the basis of the paper length and performing printing according to the embodiment of the present invention.

FIG. 6 is a flowchart illustrating a procedure of the above operation. The following procedure is executed under the control by the controller.

First, printing is performed by the master device (step s1), and image scanning is performed by the image reading apparatus (ICCU) (step s2). Thereafter, image conversion by inclination correction or the like is performed on the obtained image data (step s3), and the paper length is measured (step s4). Thereafter, the obtained paper length is notified to the slave device (step s5), the slave device changes the print start position on the basis of the paper length (step s6), and the slave device performs printing on the reversed paper (step s7).

Next, whether the job has completed is determined (step s8). If the job has not completed (No in step s8), the flow returns to step s1. If the job has completed (Yes in step s8), the procedure is terminated.

Note that papers the paper lengths of which have been acquired by the reading by the image reading apparatus 200 can be accommodated in the paper feed tray 101 of the first image forming apparatus 100 or the paper feeder (PFU) 50. The measured paper lengths are stored in a storage in association with the order of the papers (order of conveyance). Thus, it is possible to call the paper length at the time of printing to change the image formation start position.

In the present embodiment, the image formation position with respect to the back side of the paper is changed; however, an image formation position on a front side of a paper may be changed. For example, the image formation position on the front side may be changed on the basis of the paper length such that the image formation position coincides with an image formation position on the back side. Alternatively, the positions on both sides of the paper may be changed.

Second Embodiment

Next, a procedure for determining an image formation position on a second side in consideration of the length from a trailing edge of print image data to an edge of a paper and a front and back correction length will be described. Therefore, it is possible to cope with a change in the paper length after the image reading to the second image forming apparatus. The above procedure is executed by control by the controller.

In the above embodiment, the print start position in the slave device is determined by the distance Δe between the trailing edge of the print image data printed by the master device and the paper edge. However, it is also possible to calculate a correction length on the basis of a front and back adjustment value considering effects of fixing or the like and to determine a print start position in the slave device on the basis of the distance Δe and the correction length. This operation will be described with reference to FIG. 7.

Figure 7:
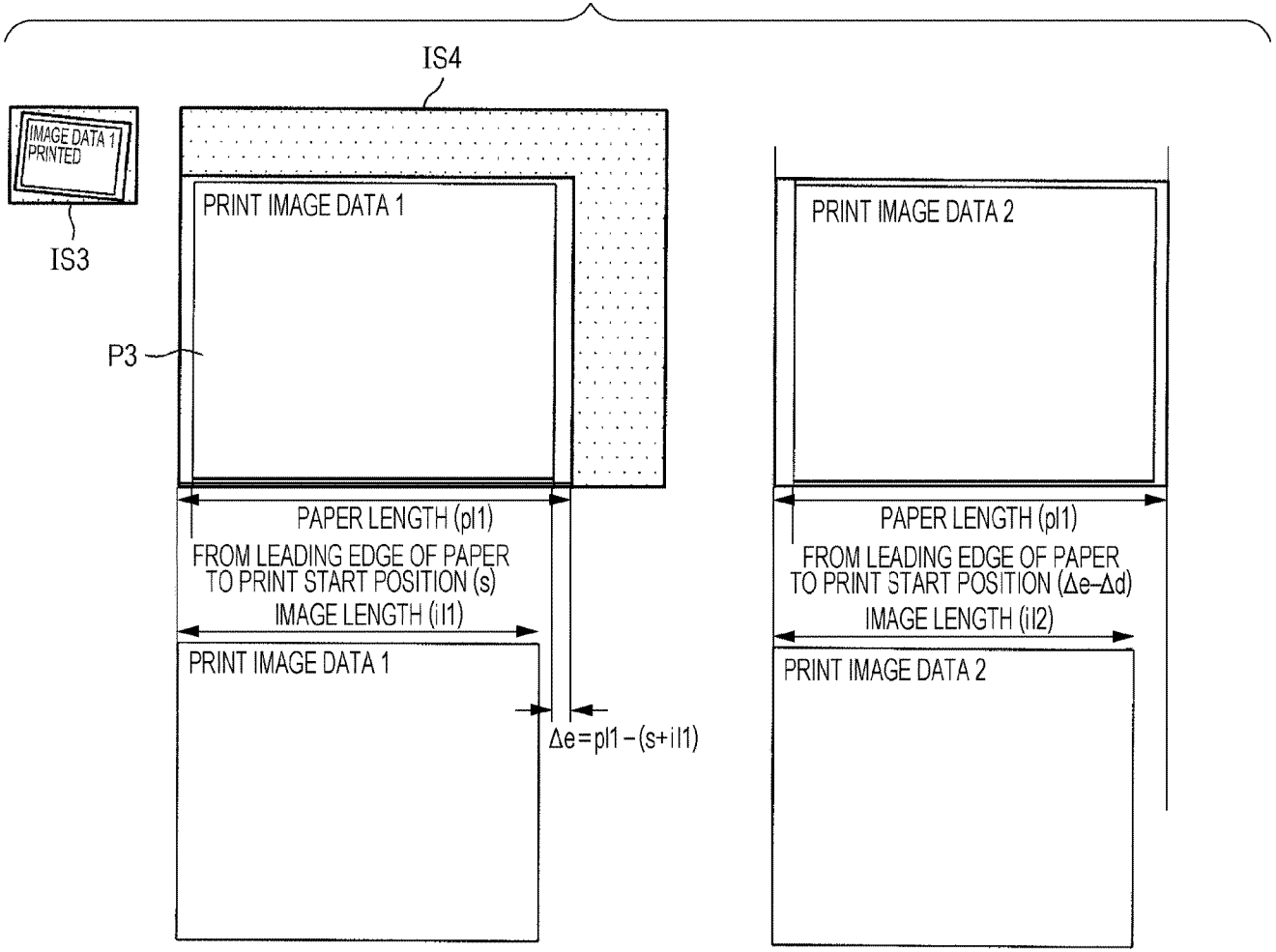
FIG. 7 is a diagram explaining a procedure of determining a print start position of a slave device on the basis of a difference between a paper length calculated from a scanned image of a paper and a front and back correction length according to the embodiment of the present invention.

As illustrated in FIG. 7, the first image forming apparatus 100 scans a first side of a paper on which an image is formed to acquire a scanned image IS3, the inclination or position of a paper image included in the scanned image IS3 is corrected to acquire a scanned image IS4 including a first side image P3. A paper length (pl1) is measured using the scanned image IS3. By subtracting the image length (il1) after magnifying the front side and the back side and the print start position (s) from the paper length (pl1), and a length Δe from a trailing edge of the first side image P3 to a trailing edge of the paper is calculated from the following mathematical formula. The image length (il1) after magnifying the front side and the back side and the print start position (s) can be acquired from job data for printing.

$$\Delta e = pl1 - (s + il1) \qquad \text{Mathematical Formula}$$

Thereafter, a correction length Δd is subtracted from the calculated Δe, and printing on the slave device is performed with Δe−Δd used as the leading edge of the paper to the print start position at the time of printing on the back side.

The value Δd includes correction values for mechanical (e.g. temperature correction), effects of fixing, or the like. The value of Δd may be set in advance or may be set by a user. Furthermore, by associating Δd with a paper profile, it is possible to make a correction in accordance with a paper even if switching of printing papers occurs.

According to this embodiment, it is also possible to cope with a paper of an irregular size by devising the paper length detection algorithm, which can also be included in Δd associated with the paper profile. This enables aligning image positions of the front side and the back side even with papers having different paper lengths, thereby enabling preventing misalignment between the front side and the back side.

Figure 8:
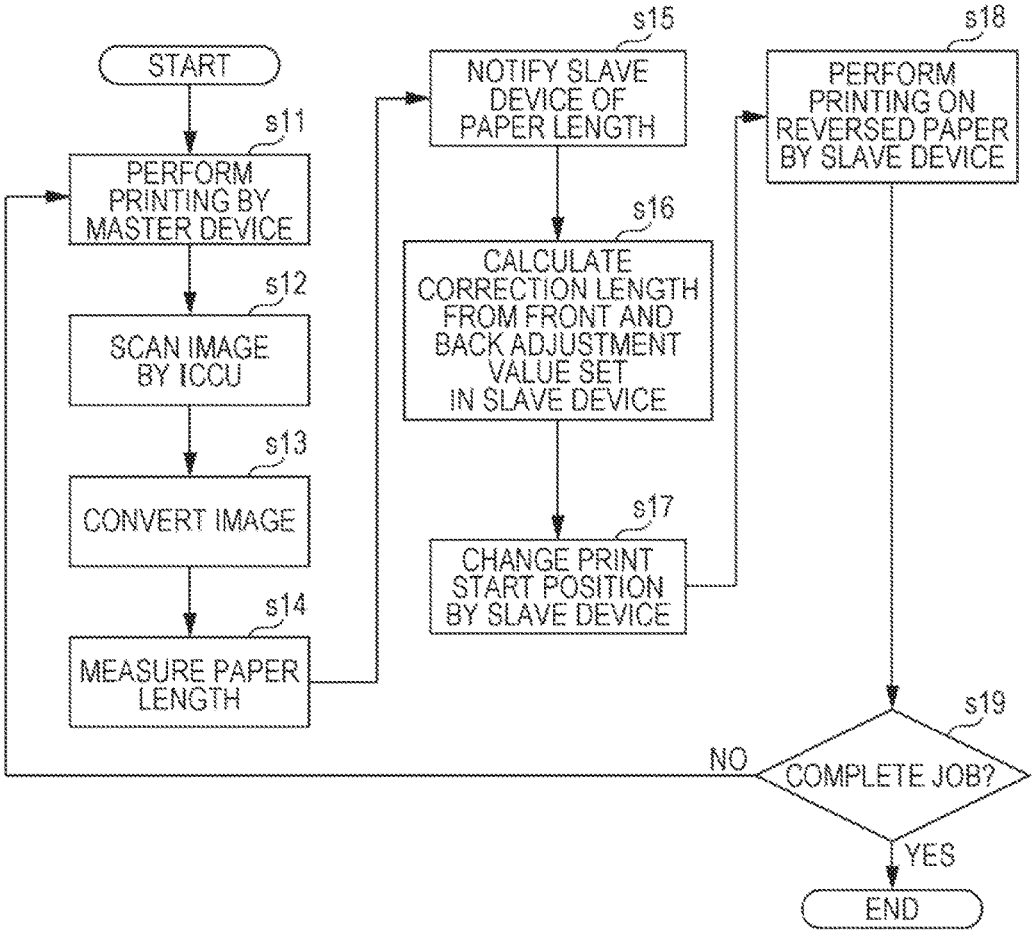
FIG. 8 is a flowchart illustrating a procedure of determining a print start position on the basis of a paper length and a front and back correction length and performing printing according to the embodiment of the present invention.

FIG. 8 is a flowchart illustrating a procedure of the above operation. The following procedure is executed under the control by the controller.

First, printing is performed by the master device (step s11), and image scanning is performed by the image reading apparatus (ICCU) (step s12). Thereafter, image conversion including inclination correction or the like is performed on the obtained image data (step s13), and the paper length is measured (step s14).

Thereafter, the obtained paper length is notified to the slave device (step s15), and the correction length is calculated from the front and back adjustment value set in the slave device (step s16). The slave device changes the print start position on the basis of the paper length and the correction length (step s17), and the slave device performs printing on the reversed paper (step s18).

Next, whether the job has completed is determined (step s19). If the job has not completed (No in step s19), the flow returns to step s1. If the job has completed (Yes in step s19), the procedure is terminated.

Third Embodiment

In the above embodiment, the print start position in the slave device is determined using the paper length. However, when a register mark for positioning is printed on a paper, the print start position in the slave device may be determined on the basis of a distance from the register mark to a trailing edge of the paper.

Figure 9:
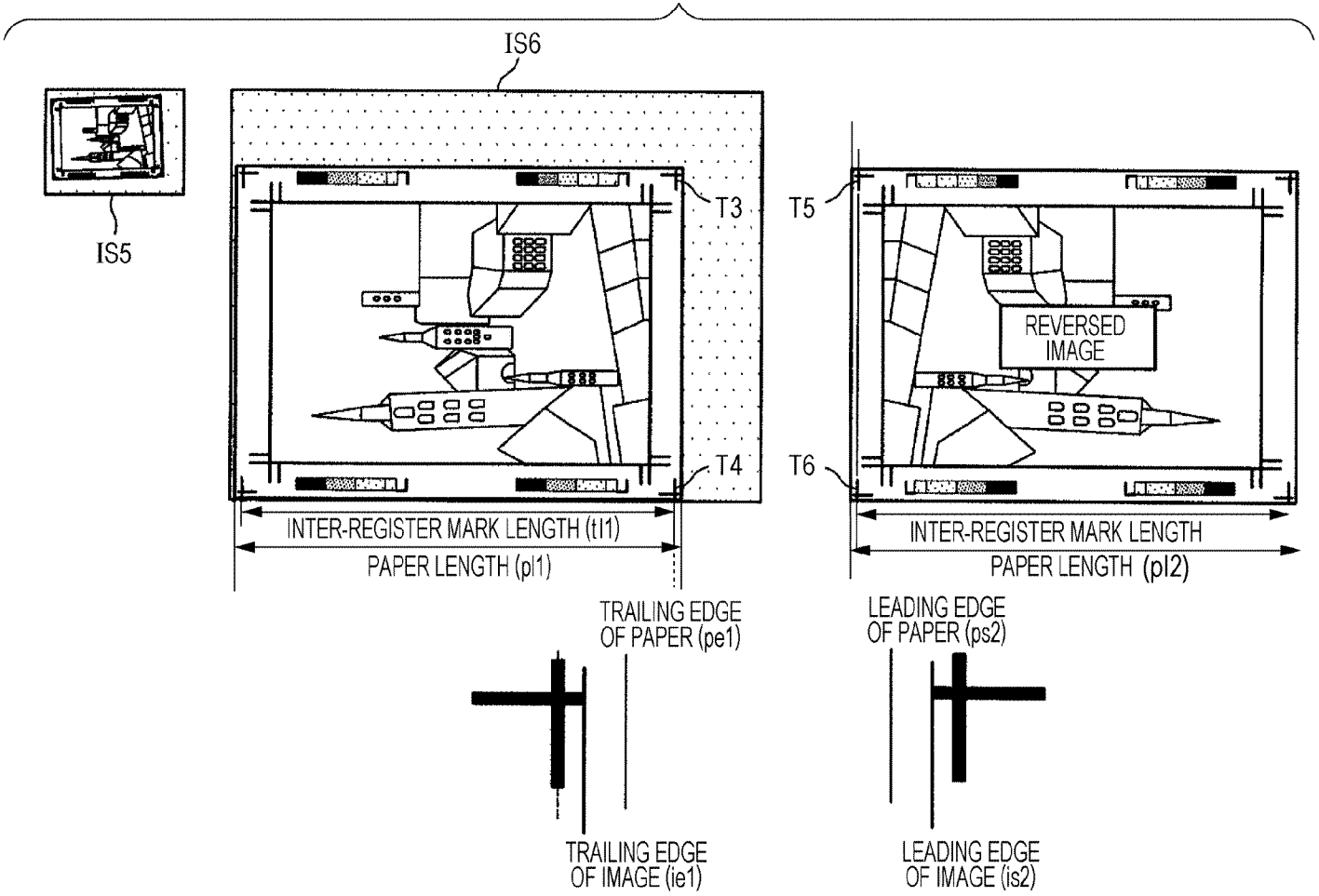
FIG. 9 is a view explaining a procedure of determining a print start position of a slave device on the basis of a distance between a register mark for positioning and a paper edge according to the embodiment of the present invention.

FIG. 9 is a view explaining an example of determining a print start position in the slave device on the basis of the length from a register mark to a trailing edge of a paper.

A paper surface including an image printed by the master device is read by the image reading apparatus 200 to acquire a scanned image IS5, and the position or inclination is corrected to obtain a scanned image IS6. The position of the register mark is detected from the scanned image IS6.

In accordance with the paper length (pl2) at which shrinkage after fixation is expected, an inter-register mark length (tl2) generally corresponds by laterally changing magnification. With the paper length alone, an influence of a difference in shrinkage factor due to local paper characteristics from the leading edge of the paper to the register mark for positioning (prediction is not possible since a fiber distribution of a paper is not uniform and has directivity and randomness) is not considered, and thus there is no possibility that correspondence is not achieved.

In consideration of the above points, the length from a register mark T3 or T4 on a trailing side of the paper to the trailing edge of the paper is calculated.

In the case of printing on a second side of the paper, the image start position is determined with the calculated paper length used as the distance from the leading edge of the paper to the register mark T5 or T6. This enables preventing misalignment in the front side and the back side of the images on the paper. In a case where a register mark for positioning is printed as described above, it is possible to perform more accurate positioning.

Figure 10:
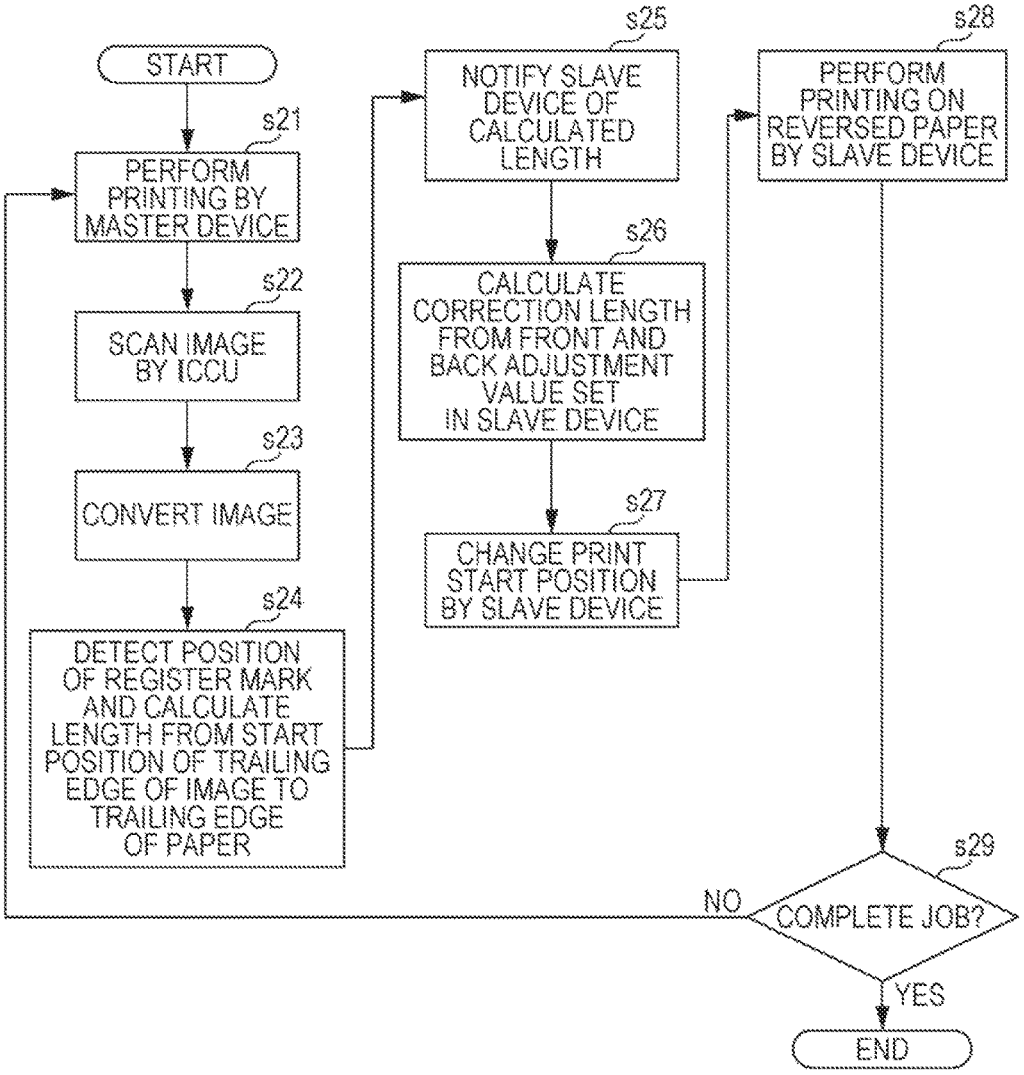
FIG. 10 is a flowchart illustrating a procedure of determining a print start position of a slave device on the basis of a distance between the register mark for positioning and the paper edge and performing printing according to the embodiment of the present invention.

FIG. 10 is a flowchart illustrating a procedure of the above operation. The following procedure is executed under the control by the controller.

First, printing is performed by the master device (step s21), and image scanning is performed by the image reading apparatus (ICCU) (step s22). Thereafter, image conversion by inclination correction or the like is performed on the obtained image data (step s23), the position of a register mark is detected from the image data to calculate the length from the trailing edge image start position to the trailing edge of the paper (step s24).

Thereafter, the calculated length is notified to the slave device (step s25), and a correction length is calculated from a front and back adjustment value set in the slave device (step s26). The slave device changes the print start position on the basis of the length from the trailing edge image start position to the trailing edge of the paper and the correction length (step s27). Thereafter, printing is performed on the reversed paper (step s28). When step s28 is completed, whether the job has completed is determined (step s29). If the job has not completed (No in step s29), the flow returns to step s21. If the job has completed (Yes in step s29), the procedure is terminated.

Fourth Embodiment

In the above embodiment, the paper length is acquired after the printing by the master device has completed. However, paper lengths of all the papers may be measured before printing to store the paper lengths in a storage medium, and the paper lengths may be read at the time of printing to change an image formation position on a paper on the basis of the paper length. In this case, by storing the paper lengths in association with the order of conveyance of the papers, it becomes possible to accurately read information on the paper length of a paper used for printing in the order of conveyance, thereby enabling correctly performing prevention of misalignment between a front side and a back side. The paper length may be stored in the HDD 156 or 356, the nonvolatile memory 159*c* or 359*c*, or the like, or may be stored in a storage of another apparatus.

Moreover, in a case where the order of papers is changed due to occurrence of a jam or the like, correction may be performed such that the order of reading data does not change. For example, reading of data may be skipped for the number of ejected papers. In a case where the order of papers is changed, by adjusting association such that the association among the changed order of papers and the paper lengths are correct, it is possible to appropriately adjust the image formation position. In addition, when the ejected paper is accommodated again in a paper tray, a user may be prompted to confirm to allow all the papers to be scanned again to measure the paper lengths again.

Measurement of the paper length can be performed by conveying a paper without performing image formation in the first image forming apparatus 100 and performing the measurement by the sensors 103 and 104 or can be performed on the basis of the reading result acquired by the reader 220 of the image reading apparatus 200. Thereafter, the ejected paper is again accommodated in the paper feeder (PFU) 50 or a paper tray of the first image forming apparatus 100, and the data of the paper lengths associated with the order of papers is read out at the time of printing, thereby enabling changing the image formation position.

Note that measurement of the paper length is only required to be performed before image formation on the back side, and a measurement timing of the paper length is not particularly limited in the present invention. For example, the paper length necessary for a job may be measured by an apparatus external to the image forming system 1, and data storing information of the paper length may be acquired by the image forming system 1.

Figure 11:
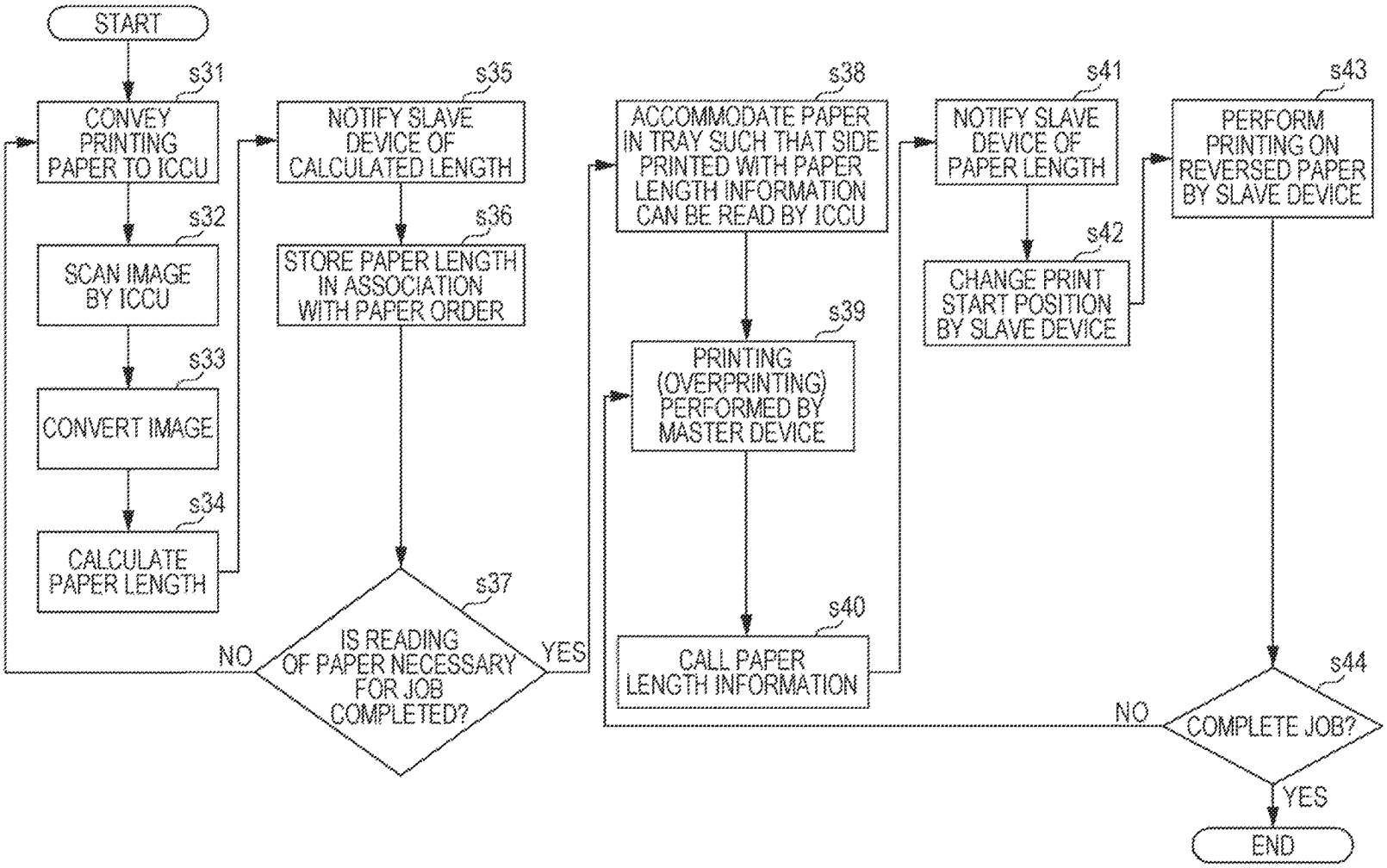
FIG. 11 is a flowchart illustrating a procedure of printing after measurement of paper lengths of all papers according to the embodiment of the present invention.

FIG. 11 is a flowchart illustrating a procedure of the above operation. Note that in the following flowchart, the measurement of the paper length is performed by the image reading apparatus (ICCU); however, a paper length measurer may perform the measurement.

First, a printing paper is conveyed to the image reading apparatus (ICCU) (step s31), and the paper is scanned by the image reading apparatus (ICCU) (step s32). Thereafter, image conversion including inclination correction and the like is performed on the obtained image data (step s33), and the paper length is calculated from the image data (step s34). Thereafter, the calculated paper length is notified to the slave device (step s35). In the slave device, the notified paper length is printed in a cutting margin or the like. The calculated paper length is stored in the storage in association with the order of paper conveyance (step s36). An installation location of the storage is not particularly limited and may be any one of the image forming apparatuses or may be stored in an external storage connected by a network, a cable or the like. Next, whether reading of the paper necessary for the job has completed is determined (step s37). If the reading of the paper necessary for the job has not completed (No in step s37), the flow returns to step s31. If the reading of the paper necessary for the job has completed (Yes in step s37), the flow proceeds to step s38.

In step s38, the paper is accommodated in a tray such that a surface on which the paper length information is printed can be read by the image reading apparatus (ICCU) (step s38). Note that the paper length information may not be printed on the paper. When step s38 is completed, printing is performed by the master device (step s39). Thereafter, the paper length information is called (step s40). When the order of papers to be fed is changed due to JAM or the like, the paper length and order stored in the storage are corrected in accordance with the change and thereby stored in the storage. The paper length read from the storage is notified to the slave device (step s41). The print start position is changed by the slave device on the basis of the paper length (step 42), and the slave device performs printing on the reversed paper (step s43).

When step s43 is completed, it is determined whether the job has completed (step s44). If the job has not completed (No in step s44), the flow returns to step s39. If the job has completed (Yes in step s44), the procedure is terminated.

In the above embodiments, a formation position of an image is changed on the basis of the change in the paper length. However, in each of the embodiments, predetermined processing may be performed in a case where the paper length of a paper to be conveyed is shorter than a predetermined length. Examples of the predetermined processing include ejecting a waste paper, clipping an image, an affine change to accommodate an image in an image forming area of the transfer medium, and notification to a user.

Examples of the predetermined length include a threshold value for determining as a waste paper or those with which an image area is not accommodated within the paper.

According to an embodiment of the present invention, by acquiring the length of a transfer medium from a detection result, image formation can be appropriately performed.

Although embodiments of the present invention have been described and illustrated in detail, it is clearly understood that the same is by way of illustration and example only and not limitation, appropriate modifications to the above embodiments can be made without departing from the scope of the present invention, and the scope of the present invention should be interpreted by terms of the appended claims.

What is claimed is:

1. An image forming system, comprising:

an image former that performs image formation on a transfer medium;

a controller that acquires a detection result of detecting the transfer medium by a detector with respect to a length of the transfer medium;

a plurality of image forming apparatuses connected in series along a conveyance direction of the transfer medium;

a first image former included in an image forming apparatus in an earlier stage, the first image former performing image formation on a first side out of both sides of the transfer medium;

a second image former included in an image forming apparatus in a later stage, the second image former performing image formation on a second side which is an opposite side to the first side of the transfer medium; and a reverser that reverses a front side and a back side of the transfer medium such that a leading edge and a trailing edge thereof are switched after passing the first image former, wherein the controller sets an image forming condition for the transfer medium on the basis of the length of the transfer medium obtained from the detection result; and wherein the controller receives a detection result, by the detector, of detecting a positioning image formed on the transfer medium in the first image former and calculates a length from the positioning image to an edge of the transfer medium as the length of the transfer medium.

2. The image forming system according to claim 1, wherein the controller sets the image forming condition for the transfer medium on the basis of the length of the transfer medium according to the detection result in a case where printing is performed on both sides of the transfer medium.

3. The image forming system according to claim 2, wherein the controller sets, to the transfer medium a front side and a back side of which are reversed such that a leading edge and a trailing edge thereof are switched after the image former has performed image formation on a first side out of the both sides of the transfer medium, an image formation position in accordance with a distance from the leading edge of the transfer medium.

4. The image forming system according to claim 1, further comprising:

a plurality of image formers, wherein, in a case of performing printing on both sides of the transfer medium, the image forming system performs printing on a first side out of the both sides of the transfer medium by a first image former out of the image formers and performs printing on a second side which is an opposite side to the first side by a second image former out of the image formers.

5. The image forming system according to claim 1, further comprising the detector.

6. The image forming system according to claim 5, wherein the detector is a transfer medium length measurer.

7. The image forming system according to claim 5, wherein the detector is an image reader that reads an image of the transfer medium, and the controller acquires a reading result of the image reader and calculates the length of the transfer medium.

8. The image forming system according to claim 7, wherein the controller calculates a length of a side of a transfer medium area from the reading result of the image reader to calculate a length of the transfer medium over the entire length.

9. The image forming system according to claim 5, wherein the detector continuously detects the transfer medium conveyed on the basis of a job.

10. The image forming system according to claim 5, wherein the detector is included on a transfer medium supply side where the transfer medium is supplied to the image former.

11. The image forming system according to claim 5, wherein the detector is included on an upstream side of the image former.

12. The image forming system according to claim 1, wherein the controller determines an image formation position on the transfer medium as the image forming condition on the basis of the length of the transfer medium.

13. The image forming system according to claim 12, wherein the controller sets a start position of image formation in the determination of the image formation position.

14. The image forming system according to claim 12, wherein, in a case of forming images on both sides of the transfer medium, in the determination of the image formation position, the controller determines the image formation position for image formation on a second side which is an opposite side to a first side for the transfer medium the first side of which out of the both sides thereof has been printed.

15. The image forming system according to claim 1, wherein the controller performs predetermined processing when the length of the transfer medium does not satisfy a predetermined length.

16. The image forming system according to claim 15, wherein the predetermined processing is one or more of ejecting a waste paper, clipping an image, an affine change to accommodate an image in an image forming area of the transfer medium, and notification to a user.

17. The image forming system according to claim 1, further comprising:

a communicator that performs communication between the controller and the image forming apparatus in the later stage, wherein the controller transmits the image forming condition for the transfer medium via the communicator before performing image formation in the image forming apparatus in the later stage.

18. The image forming system according to claim 1, wherein the detector is included between an image forming apparatus in an earlier stage and an image forming apparatus in a later stage.

19. The image forming system according to claim 1, wherein the controller determines an image forming condition in the second image former on the basis of the length of the transfer medium and a front and back adjustment value set in an image forming apparatus in a later stage.

20. The image forming system according to claim 1, further comprising:

a storage, wherein the controller stores the length of the transfer medium and an order of the transfer medium in association with each other in the storage and, upon image formation processing, reads the length of the transfer medium, of which turn of performing image formation has come, from the storage to set the image forming condition.

21. The image forming system according to claim 20, wherein the controller detects the length of the transfer medium by the detector before image formation to acquire the length of the transfer medium.

22. The image forming system according to claim 21, wherein, in a case where the order of the transfer medium is changed, the controller corrects the length of the transfer medium and the order stored in the storage in accordance with the change and stores the corrected length of the transfer medium and the order in the storage.

23. The image forming system according to claim 1, wherein the length of the transfer medium is the length of the transfer medium in a conveyance direction.

24. The image forming system according to claim 1, wherein the controller controls the image former to perform image formation in accordance with the image forming condition.

25. An image reading apparatus, comprising:

an image reader that reads an image of a transfer medium;

a hardware processor that calculates a length of the transfer medium on the basis of a detection result by the image reader; and a reading communicator that performs external communication, wherein the hardware processor transmits the calculated length of the transfer medium to an external device via the reading communicator, and wherein the hardware processor calculates a length from a positioning image to an edge of the transfer medium as the length of the transfer medium.

26. An image forming method of forming an image on a transfer medium, the method comprising:

acquiring a detection result of detecting the transfer medium by a detector with respect to a length of the transfer medium;

setting an image forming condition for the transfer medium on the basis of the length of the transfer medium obtained from the detection result; and forming the image on the transfer medium in accordance with the image forming condition, wherein the method further comprises when the length of the transfer medium does not satisfy a predetermined length, ejecting a waste paper, clipping an image, making an affine change to accommodate an image in an image forming area of the transfer medium, or notifying a user.

27. A non-transitory recording medium storing a computer readable control program executed by a controller that sets an image forming condition for a transfer medium, the control program causing the controller to perform:

acquiring a detection result of detecting the transfer medium by a detector with respect to a length of the transfer medium; and setting an image forming condition for the transfer medium on the basis of the length of the transfer medium obtained from the detection result, provided that when the length of the transfer medium does not satisfy a predetermined length, clipping an image or making an affine change to accommodate an image in an image forming area of the transfer medium.

* * * * *